United States Patent [19]

Adamoski et al.

[11] 4,443,007

[45] Apr. 17, 1984

[54] INSERTER WITH IMPROVED RAM MECHANISM

[75] Inventors: William Adamoski, Stamford; Alan B. Hotchkiss, Westport, both of Conn.

[73] Assignee: Pitney Bowes Inc., Stamford, Conn.

[21] Appl. No.: 456,469

[22] Filed: Jan. 7, 1983

Related U.S. Application Data

[62] Division of Ser. No. 185,856, Sep. 11, 1980, Pat. No. 4,379,383.

[51] Int. Cl.[3] ..... B65H 5/16; B65B 5/04

[52] U.S. Cl. ..... 271/269; 53/266 A; 198/740; 403/329

[58] Field of Search ..... 271/269, 142, 271; 53/266 A, 493; 198/740, 747, 748, 749, 738–740; 403/104, 105, 329, 330

[56] References Cited

U.S. PATENT DOCUMENTS

| | | | |
|---|---|---|---|
| 1,104,352 | 7/1914 | Erlandsson | 403/105 |
| 1,228,898 | 6/1917 | Frank | 403/105 |
| 2,914,895 | 12/1959 | Martin | 53/493 |
| 3,741,374 | 6/1973 | Hufford | 198/738 |

*Primary Examiner*—Bruce H. Stoner, Jr.
*Assistant Examiner*—James E. Barlow
*Attorney, Agent, or Firm*—Donald P. Walker; Melvin J. Scolnick; Albert W. Scribner

[57] ABSTRACT

An improved reciprocating ram for an envelope inserter includes a pusher which drives an enclosure from a ram pick-up station to an envelope station. Cycle time has been reduced by providing a ram return path which is beneath the elevation of the pick-up station. Thus, the next enclosure is fed to the pick-up station before the ram has completed its return stroke. The ram mechanism includes a ram carriage which rides along a pair of longitudinal rods. A ram block carrying a ram blade rides with the carriage and is keyed for vertical movement relative to the carriage. The block includes a follower which engages a longitudinal box cam having a latch adjacent its envelope station end. When the ram blade reaches the envelope station, the latch directs the follower to a lower elevation camming surface for the return stroke. The pusher is secured to the ram blade by a leaf spring catch which engages a grating on the undersurface of the blade. The pusher position is adjusted by depressing the leaf spring to release the catch.

5 Claims, 9 Drawing Figures

INSERTER WITH IMPROVED RAM MECHANISM

This is a division of application Ser. No. 185,856, filed Sept. 11, 1980, now U.S. Pat. No. 4,379,383.

BACKGROUND OF THE INVENTION

1. Field of the Invention

This invention relates generally to inserters and more particularly to ram mechanisms for driving enclosures.

2. Brief Description of the Prior Art

Inserters have played a significant role among the labor saving devices available to businesses which are engaged in the daily mailing of large numbers of pieces. Among the advantages of inserter usage has been the reduction in personnel required to process large quantities of outgoing mail. Further, mail room personnel have been relieved of the monotonous task of individually stuffing a seemingly insurmountable number of envelopes. Inserters have been particularly well adapted for use in the mailing of form letters and the like and have been employed for the insertion of personalized documents, e.g. computer generated checks, tab cards, etc. into window envelopes.

In U.S. Pat. No. 2,914,895 issued Dec. 1, 1959 to Samuel W. Martin and assigned to the assignee of the present invention, an envelope inserter having a reciprocating ram blade with an enclosure pusher secured to the blade undersurface has been described. The ram blade was mounted for reciprocal movement along a horizontal plane from a home position in front of an enclosure pick-up station to an envelope station. The pusher engaged the enclosure beneath the ram blade and drove it into the envelope.

Among the problems encountered with prior inserters was that the ram blade was required to return to its home position before the next enclosure could be loaded into the pick-up station. This was an important factor for consideration whenever attempts were made at improving throughput. In the Pitney Bowes Model 3320 inserter which employed a ram mechanism similar to that described in U.S. Pat. No. 2,914,895, the maximum throughput with tab cardenclosures was 3,200 cards per hour on an operational basis.

If attempts to improve throughput were made, the general thrust of such attempts was to increase cycle speeds. Such attempts could not be successful due to increased component wear, high noise levels and jamming. Thus, output rates could not be significantly increased due to the physical limitations of the various components. Prior attempts at increasing throughput by increasing the cycle speeds of components did not serve to reduce the significant dwell time which was required while waiting for completion of the ram return stroke.

In prior ram mechanisms the enclosure pusher was mounted beneath the ram blade. The pusher was secured in its position by a threaded screw. Often adjustment of the pusher relative to the new blade was required. To adjust the position of the pusher for accommodation of variations in enclosure widths, it was necessary for an operator to employ a screwdriver. This task was difficult for some mail room personnel.

SUMMARY OF THE INVENTION

The present invention relates to an inserter having an improved ram mechanism which removes the return path of the ram to a plane other than the plane of an insert pick-up station. Thus, the next enclosure may be transported to the pick-up station prior to the completion of the ram return stroke. Longitudinal movement of the ram mechanism along the stroke path is provided by a timing belt which extends between a driving and an idler sprocket. The driving sprocket is intermittently driven by a drive belt through an electromagnetic clutch. A drive pin is fixed to and projects from the timing belt and engages a vertical slot formed in a ram block. The ram block is keyed to a ram carriage and is free to move vertically with respect to the carriage. The carriage is in turn mounted for reciprocal movement along a horizontal plane and rides along a pair of ram rods.

The ram block includes a laterally projecting follower which engages a longitudinal box cam. During the forward ram stroke, the follower rides along an upper surface of the box cam. A latch in the box cam directs the follower into a lower camming surface for the return stroke. The cam releases the follower from the lower camming surface once the ram mechanism reaches the home station and the ram blade rises to pass over the enclosure on a forward stroke.

A further aspect of the present invention relates to the adjustable securement of the enclosure pusher to the undersurface of the ram blade by a leaf spring catch. The catch engages a grating on the undersurface of the rim blade. By depressing and sliding the spring catch, the pusher position may be adjusted.

From the foregoing compendium, it will be appreciated that it is an object of the present invention to provide an inserter of the general character described having an improved ram mechanism which is not subject to the disadvantages of the prior art as aforementioned.

A further object of the present invention is to provide an inserter of the general character described having an improved ram mechanism adapted for increased throughput.

Another object of the present invention is to provide an inserter of the general character described having improved output rate with reduced cycle speeds.

Another object of the present invention is to provide an inserter of the general character described having an improved ram mechanism which facilitates simplified adjustment of an enclosure pusher relative to a ram blade.

Yet another object of the present invention is to provide an inserter of the general character described having an improved ram mechanism which provides reliable operation while maximizing operational efficiency and reducing noise.

Another object of the present invention is to provide an inserter of the general character described having an improved ram mechanism which permits the transport of enclosures to a ram pick-up station prior to the completion of a ram return stroke.

A further object of the present invention is to provide an inserter of the general character described having an improved ram mechanism wherein the drive and return strokes of a ram blade lie in different planes.

Other objects of the invention in part will be obvious and in part will be pointed out hereinafter.

With these ends in view, the invention finds embodiment in various combinations of elements and arrangements of parts by which the said objects and certain other objects are attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
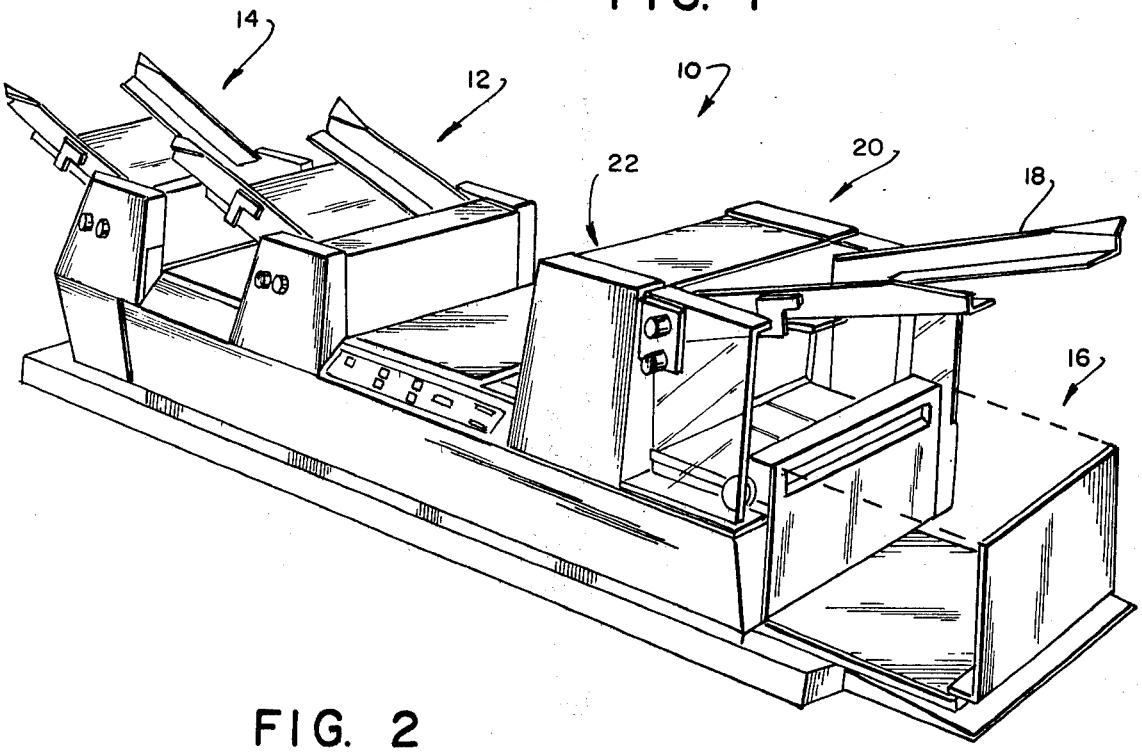
FIG. 1 is a perspective illustration of a typical inserter incorporating an improved ram mechanism constructed in accordance with the present invention and showing a pair of enclosure feeders which are operable to deliver enclosures for deposit at a ram pick-up station and an envelope feeder which delivers envelopes for deposit at an envelope station.

Referring now in detail to the drawings, the reference numeral 10 denotes generally an inserter having an improved ram mechanism constructed in accordance with and embodying the invention. The inserter 10 is similar in construction and operation to the Pitney Bowes Model 3320 Insertamate inserter and includes a first station enclosure feeder 12 and a second station enclosure feeder 14. The inserter 10 automatically stuffs enclosures from the first, second or both enclosure feeders into an envelope and delivers each stuffed envelope into a stacker tray 16. The operator loads envelopes directly from an envelope carton into a hopper 18 of an envelope feeder 20. Envelope flaps need not be pulled out since an envelope flapper 22 automatically opens the flaps prior to delivery of the envelopes to an envelope station for insertion of the enclosure.

In operation, enclosures and envelopes are individually removed from their stacks by the respective feeders 12, 14 and 20. The enclosures are carried by belts to a ram pick-up station. At the ram pick-up station, successive enclosures are engaged by a ram mechanism which stuffs them into an envelope positioned at the envelope station. The ram then carries the stuffed envelope to ejector rollers which deposit the stuffed envelope in the stacker tray 16.

The inserter 10 includes various components for the transport and loading of enclosures, as well as the feeding, flapping and delivery of envelopes, which are similar in structure to th Pitney Bowes Model 3320 inserter and the structures disclosed in U.S. Pat. No. 2,914,895 previously mentioned and which is incorporated herein by reference as if fully set forth in its entirety (hereinafter referred to as the Martin patent). The present invention relates to improvements in the ram mechanism disclosed in the Martin patent which provide increased efficiency of operation, reduced operating noise, reduced cycle speed and increased throughput.

As described in the Martin patent, the inserter 10 includes a ram mechanism 24 which rides along a pair of horizontally disposed ram rods 26 which are, in turn, supported by end walls of a base 28. The ram mechanism 24 is driven along the rods 26 by a timing belt 30 which is engaged between a driving sprocket 32 and a driven sprocket (not shown). The driving sprocket 32 is, in turn, driven through a motor drive belt and an electromagnetic clutch mechanism. Fixed to and projecting laterally from the timing belt 30 is a ram drive pin 34 which projects into a vertical slot 36 formed in a ram block 38. A thin, generally planar ram blade 40 is secured to the top of the ram block 38.

Figure 2:
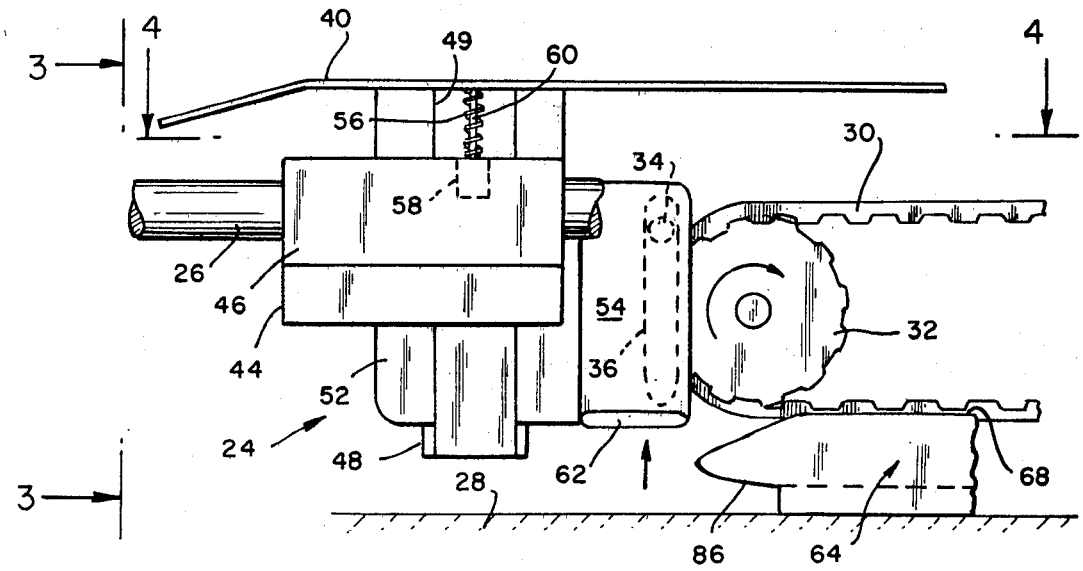
FIG. 2 is an elevational view of a ram mechanism constructed in accordance with and embodying the invention with portions of the inserter deleted and other portions broken away for clarity, the same being taken as an auxiliary view along a longitudinal plane within the base of the inserter.

FIG. 2 illustrates the ram mechanism 24 at a home station wherein the ram blade 40 is rearward of a ram pick-up station. Clockwise rotation of the drive sprocket 32 causes the ram mechanism to move toward an envelope station with the ram blade travelling in a horizontal plane. The ram mechanism 24 will reverse its direction at the envelope station when the drive pin 34 moves around the idler pulley. In the return stroke the ram blade 40 will travel in various planes beneath the horizontal plane of the forward stroke.

As illustrated in the Martin patent, a pair of belts carry an enclosure to the pick-up station which is in front of the leading edge of the ram blade 40 when the ram mechanism 24 is at its home station. The enclosure is supported by a pair of spaced deck plates which are arranged along opposite sides of the ram path between the pick-up station and the envelope station with the deck plates dipping downwardly at the pick-up station.

The ram travel path employed in the Pitney Bowes 3320 inserter and as shown in the Martin patent constituted reciprocal movement in a horizontal plane with the ram blade slightly above the deck plate surfaces and with the enclosure riding on the deck plates and straddling the span between the deck plates. In accordance with the present invention, ram cycle speed may be reduced while output rate is increased by articulating the return stroke path of the ram blade 40 so that the blade ducks underneath the pick-up station. Thus, a subsequent enclosure may be loaded into the pick-up station without waiting for the completion of the return stroke of the ram mechanism 24.

Figure 3:
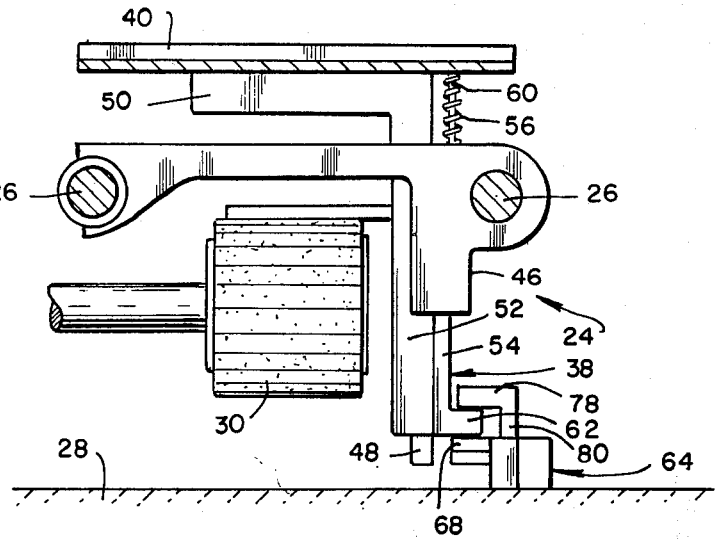
FIG. 3 is a fragmentary sectional view through the base of the inserter, the same being taken substantially along the line 3—3 of FIG. 2 and showing an improved ram mechanism constructed in accordance with the invention including a ram carriage slidable along a pair of ram rods, a ram block mounted for reciprocal movement in a vertical plane relative to the ram carriage and a box cam which is engaged by a follower projecting laterally from the ram block.
Figure 4:
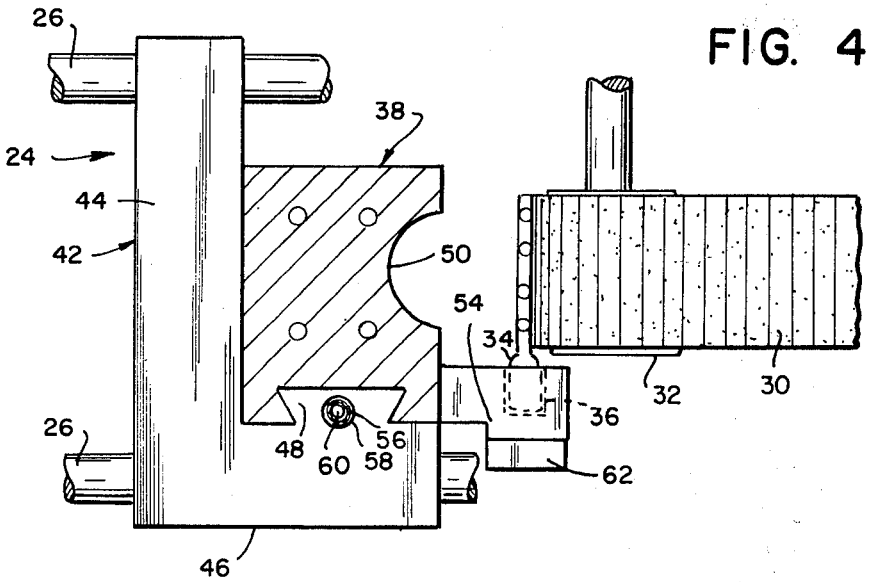
FIG. 4 is a sectional view through the ram block, the same being taken substantially along the line 4—4 of FIG. 2.

With reference now to FIGS. 2, 3 and 4 wherein the rams mechanism is shown, it will be seen that the ram mechanism 24 includes a ram carriage 42 which is slidable along the ram rods 26.

The ram carriage 42 comprises a horizontal bridge 44 which spans between the ram rods 26. The distal end of the bridge is bifurcated and includes a bushing for sliding engagement along the distal ram rod. At the opposite end of the bridge 44, the carriage 42 is elongated at a section 46 which includes a bore within which linear bearings are seated. The linear bearings are in sliding engagement with the other ram rod.

A vertical dovetail 48 projects laterally from the interior face of the section 46 towards the opposite ram rod and downwardly toward the base 28. A mating dovetail groove 49 is formed in the ram block 38. The ram block 38 includes an upper horizontal platform 50 to which the ram blade 40 is secured by screws or the like and a vertical leg 52 which includes the dovetail groove 49. By virtue of the interlocking dovetail engagement, the ram block is movable vertically with respect to the ram carriage yet both move simultaneously along the axis of the ram rods 26.

As shown in FIGS. 2 and 4, the leg 52 includes an enlarged extension or boss 54 which projects toward the envelope station. The vertical slot 36 is formed in the boss 54.

With the ram mechanism 24 in the home station as shown in FIG. 2, the ram block 38 and the ram blade 40 are maintained at an uppermost elevation relative to the ram carriage 44 by a helical spring 56 which is seated in a recess 58 of the carriage 44 and engages the undersurface of the ram blade 40. An alignment pin 60 projects downwardly from the undersurface of the ram blade and is concentric with the recess 58.

The ram block 38 includes a laterally projecting follower 62 which engages camming surfaces of a box cam 64 during the forward and return strokes of the ram mechanism.

Figure 5:
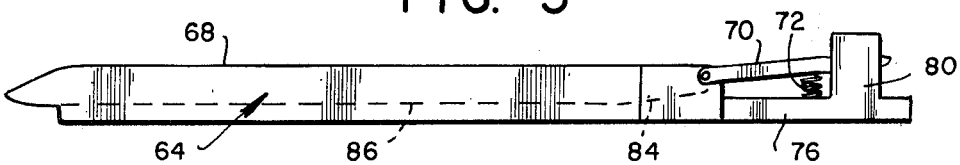
FIG. 5 is a front elevational view of the box cam which directs the ram block to a lower elevation for the return stroke of the ram mechanism.
Figure 7:
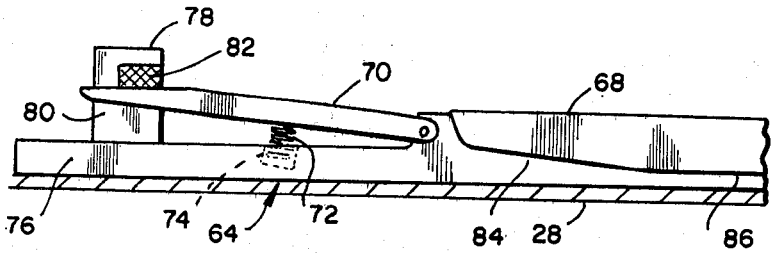
FIG. 7 is an enlarged fragmentary auxiliary view of the box cam, the same being taken substantially along the plane 7—7 of FIG. 6 and showing a spring loaded latch mechanism employed for the purpose of guiding a follower which projects from the ram block.

The box cam 64 is secured to the base 28 of the inserter 10 by a plurality of screws 66. The cam 64 includes a horizontal upper camming surface 68 which is engaged by the lower surface of the follower 62 during the forward stroke of the ram. As the ram mechanism 24 approaches the envelope station, the follower engages the upper surface of a spring biased latch 70 which is hinged to the box cam. The follower 62 depresses the latch 70 from the position shown in FIGS. 5 and 7 simultaneously compressing a helical coil spring 72.

The spring 72 is seated in a recess 74 formed in a lower extension 76 of the cam base which projects beyond the upper camming surface 68 and lies beneath the latch 70. The latch 70 is held in its upper position against the bias of the spring 72 by an overhanging horizontal stop 78 which projects from a support 80. The support 80 extends upwardly from the base extension 76.

The follower 62 is disengaged from the latch 70 when the ram mechanism 24 reaches the envelope station at which point the spring 72 snaps the latch 70 into engagement with the stop 78. A cushion pad 82 may be provided in the stop 78.

Figure 6:
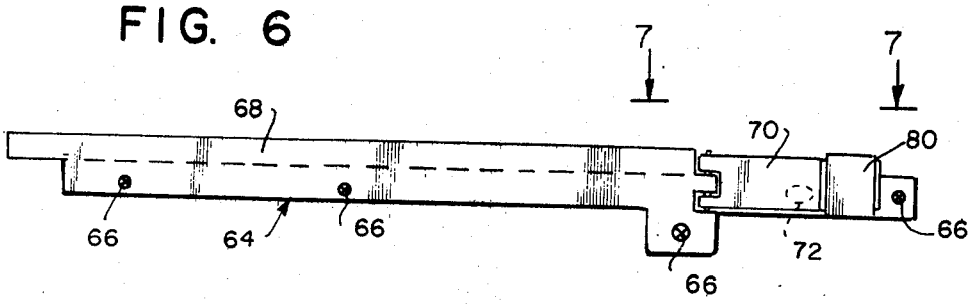
FIG. 6 is a top plan view of the box cam.

At this point, the drive pin 34 has reached the driven sprocket and begins to descend within the slot 36 of the ram block 38. The ram mechanism 24 then commences the return stroke, and the upper surface of the follower 62 will engage the curved undersurface of the latch 70. From an observation of FIG. 6, it will be noted that the spring 72 is offset and will not interfere with the return path of the follower 62.

The undersurface of the latch 70 presents a downwardly sloped surface which gradually urges the ram block 38 and the ram blade 40 to descend during the commencement of the return stroke. The downward motion of the drive pin 34 in the slot 36 assists such descent. The undersurface of the latch 70 directs the upper surface of the follower to a sloped camming surface 84 which merges with a horizontal camming surface 86. Both camming surfaces 84, 86 are formed as undercut or cut out areas of the box cam 64 directly beneath the upper camming suface 68. The follower 62 rides between the camming surfaces 84, 86 and the inserter base 28 during the return stroke.

The camming surfaces 84, 86 thus guide and maintain the ram block 38 and the ram blade 40 into a retracted position during the return stroke. In such position, the ram blade passes beneath the ram pick-up station which is being or has been loaded with the next enclosure.

When the ram mechanism 24 reaches the home station, the follower 62 is freed from the camming surface 86 and is urged upwardly by the spring 56 as well as the upward motion of the drive pin 34 in the slot 36. The ram blade 40 thus rises up into the open space between the enclosure delivery belts to an elevation above that of the ram pick-up station. A new cycle then commences a forward driving stroke.

During the forward stroke of the ram mechanism 24, the ram blade 40 passes over the enclosure which is supported by the spaced apart deck plates. The trailing edge of the enclosure engages a pusher 90 which is adjustably secured to the undersurface of the ram blade 40. The pusher 90 includes a generally planar downwardly sloped upper panel 92 and a lower upwardly sloped panel 94 lying in intersecting planes. The upwardly sloped lower panel 94 is designed to engage the undersurface of the enclosure and the downwardly sloped upper panel is designed to engage the upper surface of the enclosure during the forward ram stroke.

Approaching the line of intersection of the planes of the panels 92, 94 the upper panel 92 includes a horizontal area 96 and the lower panel 94 includes a vertical leg 98. A zone formed by the horizontal area 96 and the leg 98 provides a positive stop designed to engage the trailing edge of an enclosure.

Figure 8:
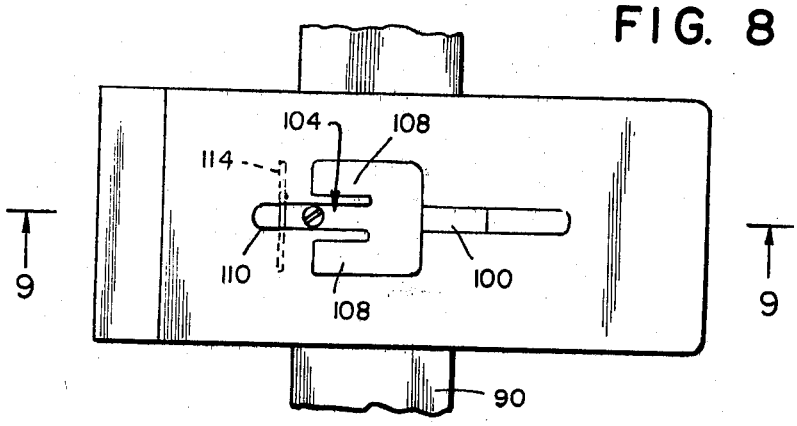
FIG. 8 is a plan view of a ram blade secured to the ram block and showing a spring catch which adjustably secures an enclosure pusher beneath the ram blade.
Figure 9:
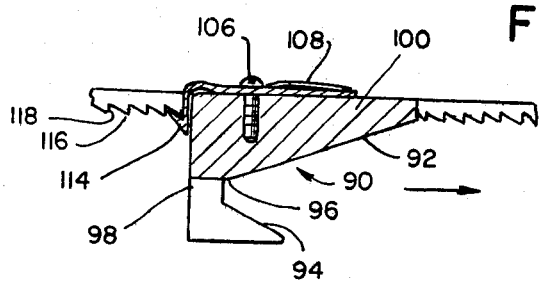
FIG. 9 is an enlarged scale fragmentary sectional view through the ram blade, the spring catch and the pusher, the same being taken substantially along the line 9—9 of FIG. 8 and showing the engagement between the catch and a grating on the undersurface of the ram blade.

Both panels 92, 94 may be formed in one piece. From an observation of FIG. 8, it will be seen that the pusher 90 extends transversely to the direction of ram stroke and projects beyond the side edges of the ram 40. The lower panel 94 thus serves to provide a support for the enclosure during the forward ram stroke, supplementing the support provided by the deck guides.

The pusher includes a proturberance 100 which extends into a longitudinal slot formed in the ram blade 40. A three legged leaf spring catch 104 is secured to the upper surface of the protuberance 100 by a suitable fastener 106. The catch 104 includes a pair of outer legs 108 which provide a downward bias against the upper surface of the ram blade 40, tending to hold the pusher 90 against the undersurface of the ram blade 40.

A center leg 110 extends downwardly beneath the slot to the undersurface of the ram blade. At its end, the center leg 110 includes transverse extensions 114 which project perpendicular to the longitudinal axis of the ram blade beneath the ram blade. The center leg 110 is upwardly biased so that the extensions 114 engage the undersurface of the ram blade.

The undersurface of the ram blade includes a grating 116 extending along an axis transverse to that of the ram blade. The grating 116 includes a plurality of parallel substantially vertical undercuts 118 which are joined by rearwardly sloping surfaces. It will be appreciated that the engagement of the extensions 114 and the undercuts 118 will strongly resist displacement of the pusher 90 toward the rear of the ram blade 40. Thus, in the event of a paper jam, the pusher 90 will maintain its position.

In the event the pusher position needs to be adjusted by virtue of a change in the nature of enclosures, the operator need only disengage the extensions 114 from the grating 116 by depressing the catch 104 and, with the same digit, sliding the pusher relative to the ram blade 40.

Thus, it will be seen that there is provided an inserter with an improved ram mechanism which achieves the various objects of the present invention and which is well suited to meet the conditions of practical use.

Since various possible embodiments might be made of the present invention and since various changes might be made of the exemplary embodiment shown, it is to be understood that all matter herein described or shown in the accompanying drawings is to be interpreted as illustrative and not in a limiting sense.

Having thus described the invention, there is claimed as new and desired to be secured by Letters Patent:

1. A ram mechanism for an envelope inserter adapted to transport enclosures from an enclosure pick-up station to an envelope positioned at an envelope station, the ram mechanism comprising a ram block, a ram blade, means securing the ram blade to the ram block, pusher means for engaging the trailing edge of an enclosure seated at the pick-up station and advancing the enclosure into the envelope, the pusher means extending downwardly from the underside of the ram blade and means adjustably securing the pusher means to the ram blade, the securing means comprising spring biasing means positioned on the upper surface of the ram blade, means securing the pusher means to the spring biasing means, the spring biasing means including means extending to the underside of the ram blade, the extending means being upwardly spring biased, means for forming a transverse grating on the underside of the ram blade, the extending means being in interlocking engagement against the grating, the extending means being operator engageable on the upper surface of the ram blade to release the spring biased engagement between the extending means and the grating whereby the position of the pusher means relative to the ram blade may be adjusted to compensate for varying width of enclosures.

2. A ram mechanism constructed in accordance with claim 1 wherein the grating comprises a plurality of grooves in the underside of the ram blade, the grooves being joined by surfaces sloping upwardly toward the rear of the ram blade, whereby the spring biased engagement of the extending means and the grating provides greater stability against rearward displacement of the pusher means relative to the ram blade than against forward displacement of the pusher means relative to the ram blade.

3. A ram mechanism constructed in accordance with claim 1 wherein the ram blade includes a longitudinal slot, the means securing the spring means to the pusher means extending through the slot.

4. A ram mechanism constructed in accordance with claim 3 wherein the extending means extends through the slot.

5. A ram mechanism constructed in accordance with claim 3 wherein the spring means includes three legs, two of the legs being biased against the upper surface of the ram blade on opposite sides of the slot and the third leg comprising the extending means.

* * * * *